US006209613B1

(12) United States Patent
Forry

(10) Patent No.: US 6,209,613 B1
(45) Date of Patent: Apr. 3, 2001

(54) SCREEN AND LOUVER GARAGE DOORWAY ENCLOSURE

(76) Inventor: Jeffrey S. Forry, 1030 Roesser Dr., Lancaster, PA (US) 17601

( * ) Notice: Subject to any disclaimer, the term of this patent is extended or adjusted under 35 U.S.C. 154(b) by 0 days.

(21) Appl. No.: 09/356,946

(22) Filed: Jul. 19, 1999

(51) Int. Cl.[7] ..... E05D 15/26; E06B 3/48

(52) U.S. Cl. ..... 160/199; 160/118; 49/129

(58) Field of Search ..... 160/199, 206, 160/104, 196.1, 183, 118; 49/61, 64, 65, 125, 128, 129

(56) References Cited

U.S. PATENT DOCUMENTS

| | | | | |
|---|---|---|---|---|
| D. 374,487 | | 10/1996 | Lacherza . | |
| 2,636,558 | * | 4/1953 | Bauders, Jr. | 160/104 |
| 2,658,571 | * | 11/1953 | Guth et al. | 160/196.1 |
| 3,029,868 | * | 4/1962 | Ogburn et al. | 160/206 |
| 3,422,878 | * | 1/1969 | Galietti | 160/199 |
| 3,990,183 | * | 11/1976 | Meggs et al. | 49/125 |
| 4,081,018 | | 3/1978 | Szwartz . | |
| 4,231,412 | | 11/1980 | Nowak . | |
| 4,642,947 | * | 2/1987 | Dickson | 160/196.1 X |
| 4,846,241 | | 7/1989 | Chomka et al. . | |
| 5,271,449 | | 12/1993 | Herrick . | |
| 5,323,835 | | 6/1994 | Bachmeier . | |
| 5,427,169 | | 6/1995 | Saulters . | |
| 5,848,630 | | 12/1998 | Manzo . | |

* cited by examiner

*Primary Examiner*—Daniel P. Stodola
*Assistant Examiner*—Hugh B. Thompson
(74) *Attorney, Agent, or Firm*—Dale J. Ream

(57) ABSTRACT

A garage doorway enclosure for mounting within the opening of a garage includes a primary guide track extending along a length of the top wall of a garage doorway. The enclosure further includes a plurality of door panels hingedly connected to each other. A guide element protrudes from each panel and is received in the primary guide track for slidable movement of the panels therealong. The panels are movable in an accordion-like manner between a closed position in which the panels cover the doorway and a folded position adjacent a side wall of the doorway. The guide element of the panel adjacent the side wall is slidable within a secondary guide track that is normal to the primary guide track such that the panels can be outwardly displaced from the doorway. The panels are pivotal from the displaced position to a storage position adjacent an outer wall of the garage. The panels each have a plurality of louvers mounted on a first side for allowing a selective amount of light into the garage, and a mesh material on a second side for allowing air to flow therethrough.

12 Claims, 8 Drawing Sheets

SCREEN AND LOUVER GARAGE DOORWAY ENCLOSURE

BACKGROUND OF THE INVENTION

This invention relates generally to an apparatus for enclosing the doorway of a garage and, more particularly, to a garage door enclosure having both a screen and louvers for allowing air and a selective amount of light into the garage.

A garage can be useful as a supplemental porch area or even as an additional room of a house, such as a playroom for children. The garage in its usual form, however, is accompanied by several disadvantages when used in this manner. The garage can become dangerously hot during the summer months if the door is left closed. On the other hand, an open garage door invites unwanted intrusion by persons or animals or allows small children to leave the garage area.

Various garage enclosures have been proposed in the art for enclosing the opening of a garage. While arguably effective in function, the known garage enclosures still exhibit certain disadvantages. Existing garage enclosures are not suitable to allow sufficient airflow in and out of the garage while also preventing intrusion and selectively regulating the amount of sunlight shining into the garage.

Therefore, it is desirable to have a garage doorway enclosure which includes a plurality of door sections that permit air to flow freely in and out of a garage. Further, it is desirable to have a garage doorway enclosure in which the door sections include louvers which may be selectively positioned to regulate the amount of sunlight passing into the garage. It is also desirable to have an enclosure which can be easily pivoted to a storage position that does not obstruct the garage opening.

SUMMARY OF THE INVENTION

Accordingly, the garage doorway enclosure according to the present invention utilizes a primary guide track extending longitudinally along a length of the top wall of the vehicle doorway of a garage. The doorway enclosure includes a first and second series of door panels in which each series includes a plurality of door panels connected to each other with hinges. A guide element extends from the top of each door panel and is received within the primary guide track such that each series of door panels may be slidably extended to cover the garage doorway or folded in an accordion-like manner toward opposite side walls of the doorway.

When the door panels are moved to the folded position, the guide elements are no longer held within the primary guide track although the guide elements of the door panels adjacent the side walls of the doorway are held within secondary guide tracks. The secondary guide tracks are generally normal to said primary guide track and extend outwardly from the plane of the doorway. Each series of folded door panels may then be slidably moved to a position outwardly displaced from the doorway. The guide elements within the secondary guide tracks are freely pivotal such that each series of door panels may be pivoted from the displaced position to a storage position adjacent the outer walls of the garage.

The interior side of each door panel is covered with a mesh material which allows air to flow in and out of the garage while preventing unwanted access by persons or animals. The exterior side of each door panel includes a plurality of louvers which can be incrementally pivoted to desired positions for selectively regulating the amount of light shining into the garage. Particular door panels may also include locking mechanisms for preventing unwanted access to the garage. The door panels may also include wheels which enhance the slidable movement of the panels.

Therefore, it is a general object of this invention to provide an apparatus for enclosing the doorway of a garage that operates independently of the conventional garage door.

Another object of this invention is to provide an apparatus, as aforesaid, having a plurality of panels which selectively enclose the doorway of the garage in an accordion like manner.

Still another object of this invention is to provide an apparatus, as aforesaid, which allows air to pass in and out of the garage through a screen mesh on each panel.

Yet another object of this invention is to provide an apparatus, as aforesaid, which allows a selected amount of light to pass into the garage through pivotal louvers on each panel.

A further object of this invention is to provide an apparatus, as aforesaid, which inhibits unwanted intrusion into the garage while maintaining adequate ventilation.

A still further object of this invention is to provide an apparatus, as aforesaid, in which the panels can be folded together and then pivoted to a storage position that does not obstruct normal use of the garage doorway.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
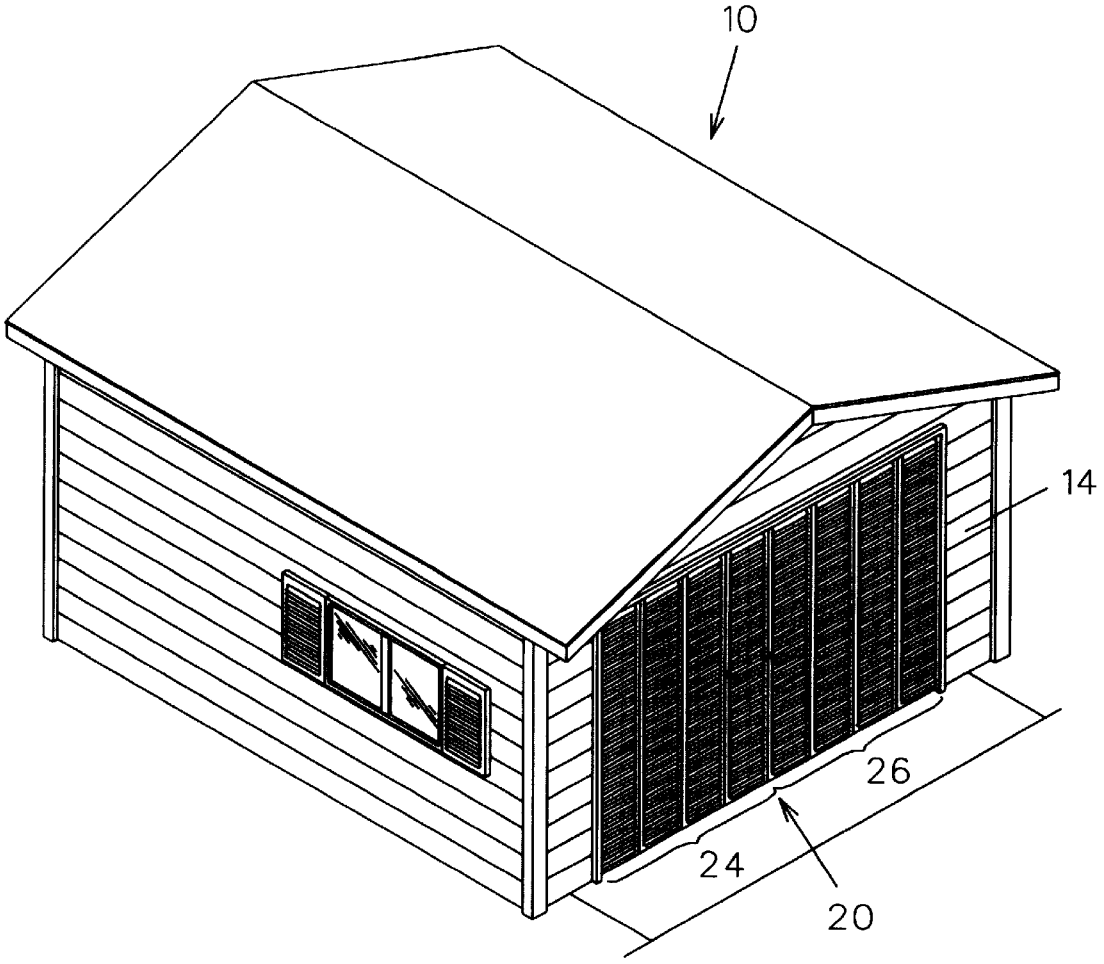
FIG. 1 is a perspective view of the garage enclosure in an extended or closed position enclosing the doorway of a garage according to the present invention.
Figure 2:
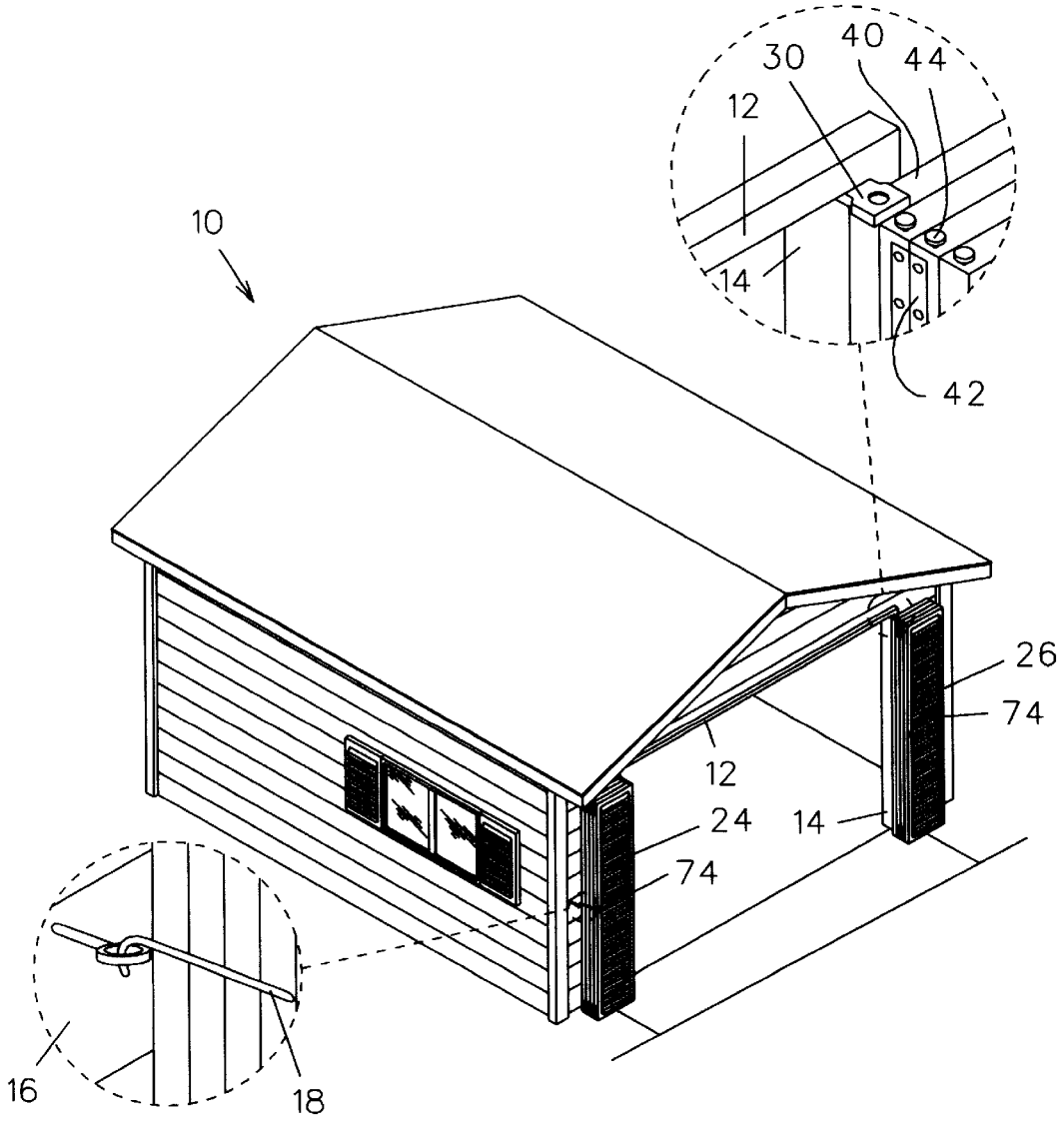
FIG. 2 is a perspective view of the garage enclosure of FIG. 1 in a folded storage position adjacent the outer wall of the garage.

Turning more particularly to the drawings, FIGS. 1 and 2 show a garage enclosure apparatus 20 mounted to a garage structure 10 according to the present invention. In a closed position, as in FIG. 1, the enclosure apparatus 20 completely covers the vehicle doorway of the garage, whereas the doorway is completely unobstructed when the enclosure apparatus 20 is folded to a storage position adjacent an outer wall (FIG. 2) as to be further described below.

Figure 3A:
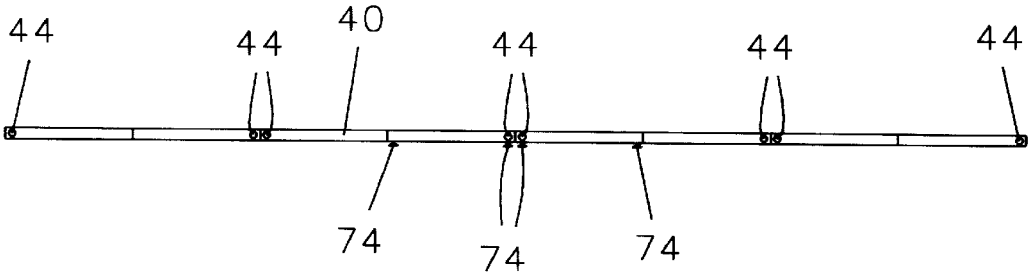
FIG. 3A is a top view of the panels of the garage enclosure of FIG. 1 in an extended or closed position.
Figure 3B:
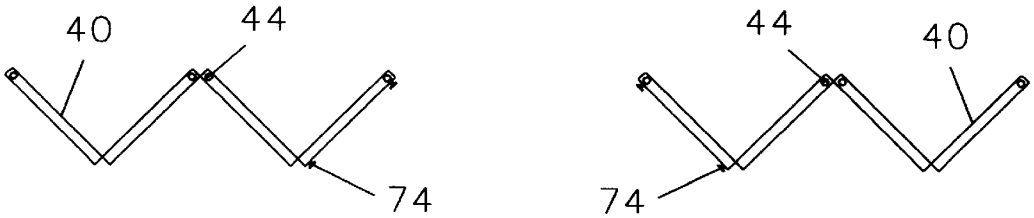
FIG. 3B is a top view of the panels of the garage enclosure of FIG. 1 in a partially open position.
Figure 3C:
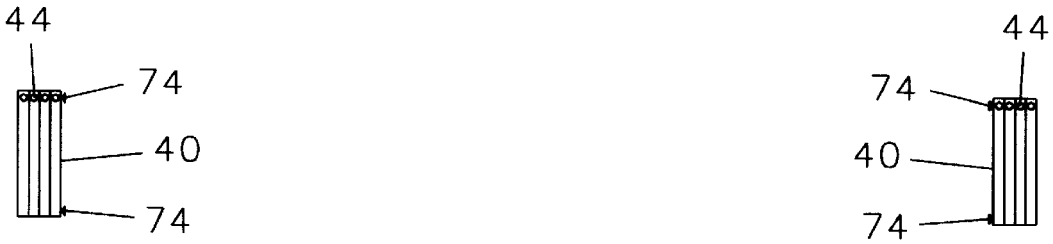
FIG. 3C is a top view of the panels of the garage enclosure of FIG. 1 in a folded or open position.
Figure 8:
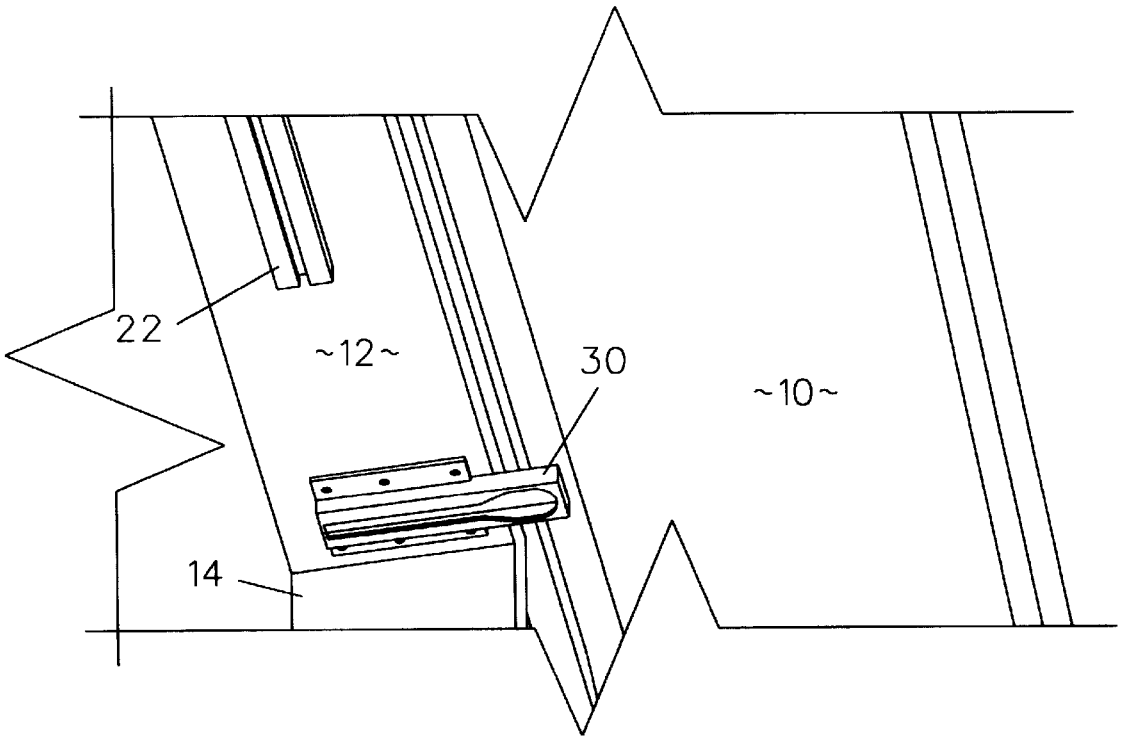
FIG. 8 is a bottom perspective view on an enlarged scale of the secondary guide track of FIG. 2 with the panels removed.

As shown more particularly in FIG. 8, a primary guide track 22 is fixedly mounted to a top wall 12 of the garage doorway and extends longitudinally along a portion thereof. The enclosure apparatus 20 includes first 24 and second 26 series of door panels coupled to the primary guide track 22 (FIG. 2) for movement in opposing directions therealong. Each series 24, 26 includes a plurality of door panels 40 coupled one to another with hinges 42. An upstanding guide element 44 extends from the top 48 of each door panel 40 adjacent a side wall 52 thereof. Each guide element 44 presents a circular top portion displaced from the top 12 of the door panel 40, the top portion being slidably receivable within the primary guide track 22 for slidable movement of the panels therealong. As each series 24, 26 of door panels is moved to the closed position, the door panels 40 are adjacent one another within the plane of the garage doorway (FIGS. 1 and 3A). As each series 24, 26 is moved toward the side walls 14 of the garage doorway, the panels 40 fold or pivot at the hinges 42 in an accordion-like manner (FIG. 3B). Ultimately, the door panels 40 may be placed in a completely folded position (FIG. 3C). When in the completely folded position, the guide elements 44 extending from the panels 40 are no longer held within the primary guide track 22 as the primary guide track 22 does not extend completely between the side walls 14 of the doorway (FIG. 8).

Figure 6D:
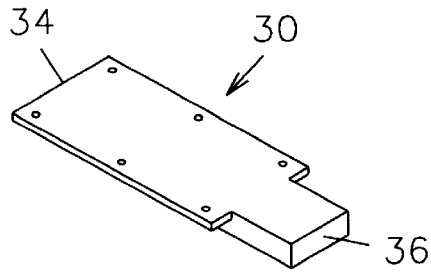
FIG. 6D is a bottom perspective view of the of FIG. 6A.
Figure 6B:
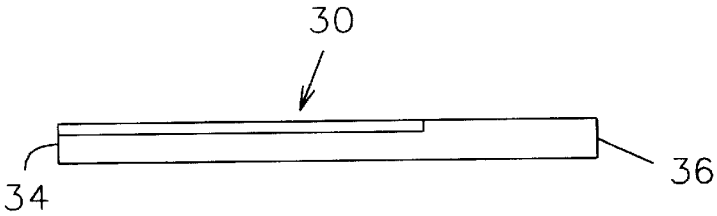
FIG. 6B is a side view of the secondary guide track of FIG. 6A.
Figure 6A:
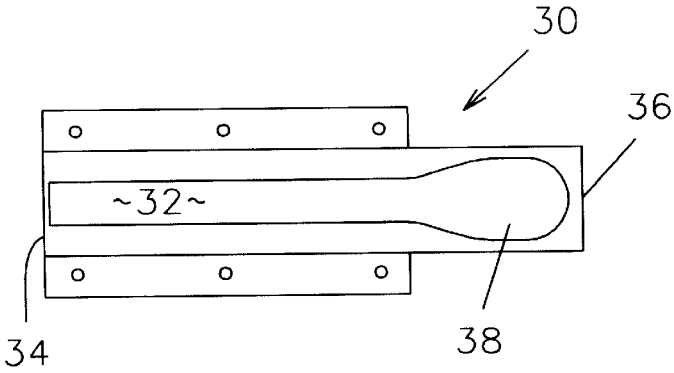
FIG. 6A is a top view of the secondary guide track of the garage enclosure.
Figure 6C:
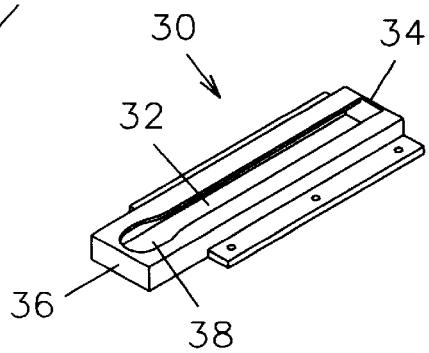
FIG. 6C is a top perspective view of the secondary guide track of FIG. 6A.

The garage enclosure apparatus 20 further includes a pair of secondary guide tracks 30 fixedly mounted to the top wall 12 of the garage doorway. Each secondary guide track 30 is positioned immediately adjacent a side wall 14 of the doorway and is normal to the plane of the doorway and primary guide track 22. The secondary guide tracks 30 extend outwardly from the doorway. As more particularly shown in FIGS. 6A and 6C, each secondary guide track 30 presents a channel 32 into which the guide element 44 of the door panel 40 immediately adjacent the corresponding side wall 14 is slidably received. A first end 34 of the channel 32 of each secondary guide track 30 is within the plane of the doorway and primary guide track 22. Accordingly, each series 24, 26 of door panels in folded positions may be slidably displaced outwardly from the plane of the doorway as the panels adjacent the side walls 14 are moved along the secondary guide tracks 30. An enlarged opening 38 at the second end 36 of the channel 32 allows the panels 40 to be completely removed from the enclosure apparatus 20, if desired.

The guide elements of the panels 40 adjacent the side walls 14 are pivotal within the secondary guide tracks 30. Therefore, each series 24, 26 of door panels may be pivoted from the displaced position to a storage position adjacent an outer wall 16 of the garage as in FIG. 2. Each series 24, 26 of door panels may be releasably coupled to the outer wall 16 with a hook 18 or other similar fastener.

Figure 4:
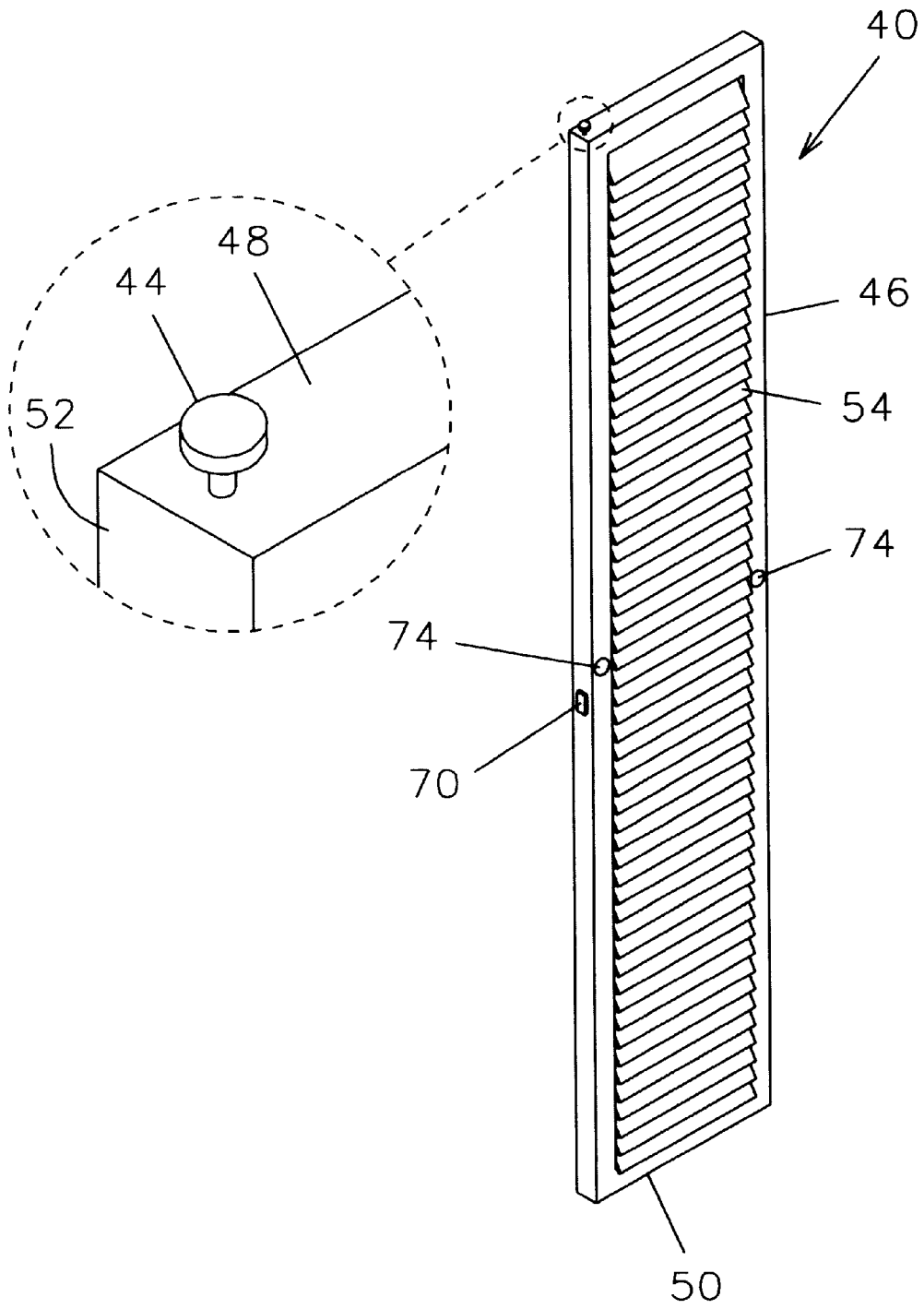
FIG. 4 is a front perspective view of a panel of the garage enclosure with an enlarged isolated view of a guide element thereon.
Figure 5:
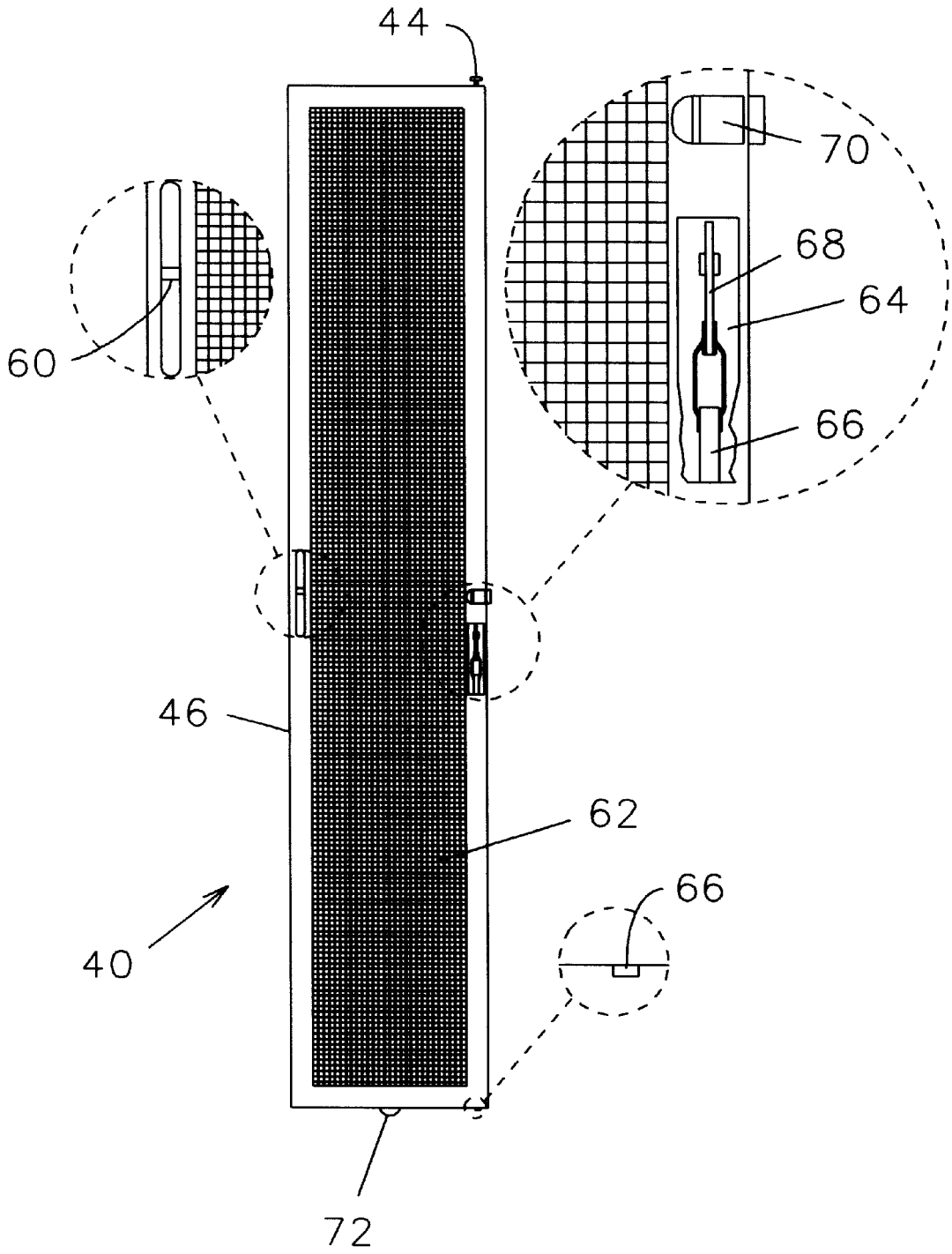
FIG. 5 is a rear view of a panel of the garage enclosure of FIG. 1 with enlarged isolated views of the locking assembly and louver adjustment lever.
Figures 7A, 7B:
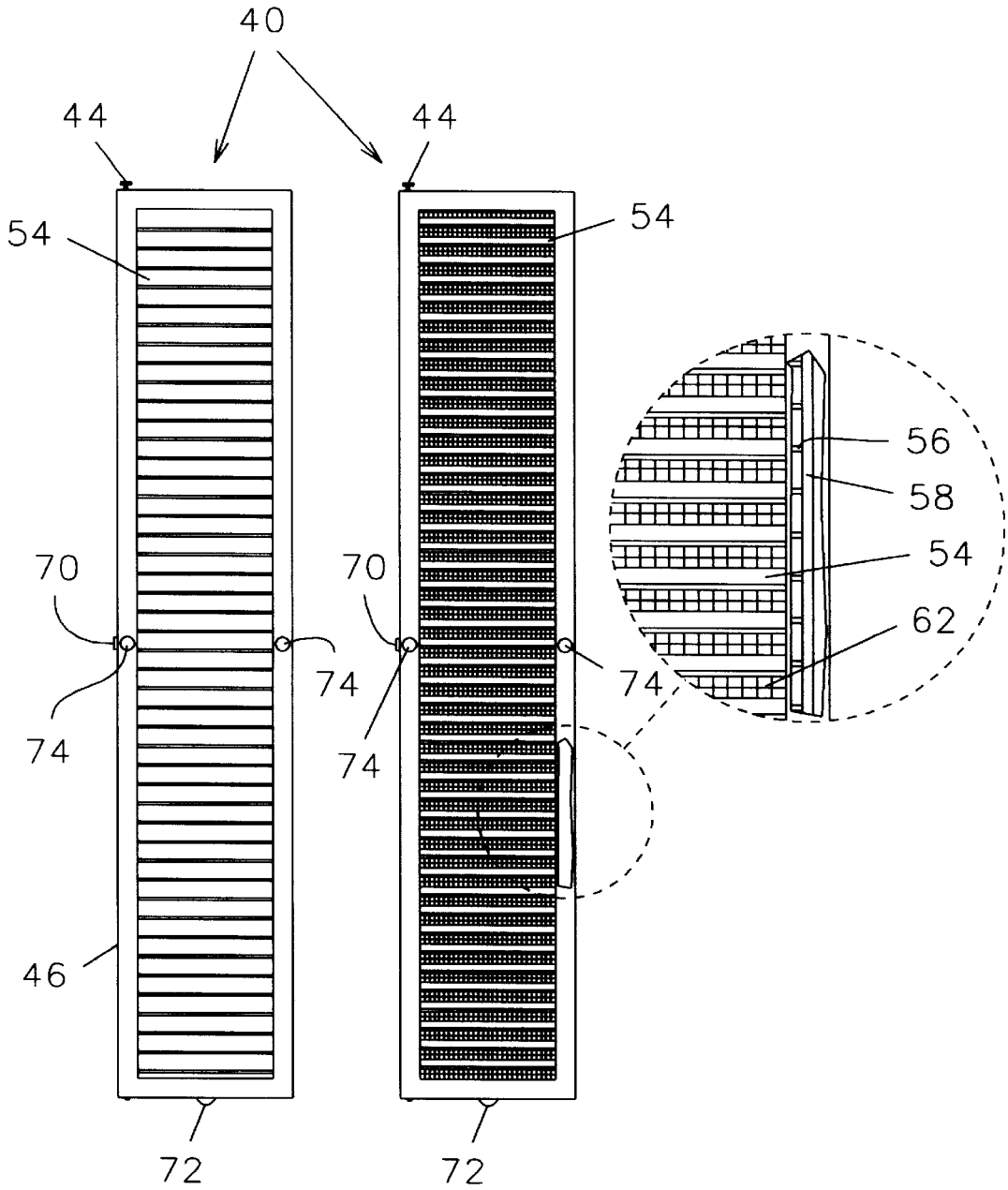
FIG. 7A is a front view of a panel of the garage enclosure of FIG. 1 with the louvers in a closed position.
FIG. 7B is a front view of a panel as in FIG. 7A with the louvers in an open position and with an enlarged isolated view of the louver pivot mechanism.

Referring now to FIGS. 4, 7A, and 7B, the exterior side of each door panel 40 includes a frame 46 with a plurality of louvers 54 mounted adjacent one another thereon. The louvers 54 pivot incrementally between closed (FIG. 7A) and open (FIG. 7B) positions. At the closed position, the louvers 54 are substantially vertical, and at the full open position the louvers 54 are substantially horizontal. Thus, the louvers 54 may pivot approximately 90 degrees to regulate the amount of air and light permitted to enter the garage. Each louver 54 includes an axle 56 coupled to a connecting rod 58 extending longitudinally through the frame 46. The connecting rod 58 is coupled to a handle 60 extending through the interior side of the frame 46 (FIG. 5). Accordingly, movement of the handle 60 affects movement of all of the louvers 54 of the panel 40.

A mesh material 62 covers the interior side of the frame 46 of each panel 40 (FIG. 5). The mesh material may be a wire or nylon screen or other suitable material. Particular panels 40 may include a locking mechanism 64 or "lock-down" such as is known in the art (FIG. 5). The locking mechanism 64 includes a bar 66 which extends vertically through the panel frame 46 and is movable between locked and unlocked positions according to user movement of a lever 68. In the locked position, the bar 66 protrudes from the bottom of the panel frame 46 and mates with an aperture in the garage or driveway surface. It is understood that only one panel 40 in each series 24, 26 is equipped with a locking mechanism 64. The free panels of each series 24, 26 of door panels also include a conventional deadbolt locking mechanism 70 for releasably coupling the series 24, 26 together (FIGS. 4 and 5).

Each panel 40 further includes a wheel assembly 72 mounted to the bottom of the frame 46. The wheel assembly 72 may be attached with a spring such that the assembly may be withdrawn into a recess in the panel frame 46 when the locking mechanism 64 is in a locked position. Some panels also include knobs 74 for user grasping of the panels 40 during the opening or closing of the enclosure apparatus 20 (FIGS. 1 and 3B).

In operation, first 24 and second 26 series of hingedly connected door panels 40 are slidably coupled to the primary guide track 22 and may be extended therealong for completely covering the vehicle doorway of a garage 10. The mesh material 62 on each panel 40 allows air to freely circulate into and out of the garage 10. The plurality of louvers 54 on each panel may be selectively pivoted to regulate the entry of light into the garage 10. The series 24, 26 may also be slidably moved toward opposed side walls 14 of the doorway in an accordion-like manner such that the doorway is unobstructed. When the guide elements 44 of each of the door panels 40 are released from the primary guide track 22 and each series 24, 26 is in a folded position, each series 24, 26 may be displaced outwardly from the plane of the doorway by slidably urging the panels along the secondary guide tracks 30. Each series 24, 26 may then be pivoted to a storage position adjacent the outer wall 16 of the garage 10.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An apparatus for a garage having an outer wall with a doorway formed therethrough, the doorway having a pair of spaced apart side walls and a top wall, comprising:

a guide track adapted to be fixedly mounted to the top wall of the doorway and to extend longitudinally therealong;

a plurality of panels hingedly connected one to the other;

means for slidably mounting said plurality of panels to said guide track for movement of said panels in an accordion-like manner, said mounting means including a guide element protruding from each said panel, said guide track receiving said guide elements for slidable movement of said panels therealong between a first extended position enclosing the doorway in a plane with said guide track and a second folded position in which the panels are normal to the plane of said guide track;

each of said panels including a first side having a plurality of louvers pivotally mounted thereto for allowing a selective amount of light into the garage;

a second guide track adapted to be fixedly attached to the top wall of the doorway and positioned adjacent a side wall thereof and normal to said guide track, said second guide track being spaced apart from said guide track and adapted to receive one of said guide elements therein for slidable movement of said plurality of panels from said second folded position to a third position displaced from said guide track.

2. An apparatus as in claim 1 wherein each said panel further includes a second side having a mesh material thereon for allowing air to flow therethrough.

3. An apparatus as in claim 1 wherein said one guide element is pivotal within said second guide track for pivotal movement of said plurality of panels from said third displaced position to a fourth position adjacent an outer wall of the garage.

4. An apparatus as in claim 1 wherein each said panel includes a rod coupled to said louvers for urging said louvers between a closed position and a selected open position.

5. An apparatus as in claim 1 wherein each said panel includes a wheel mounted to a bottom side thereof for movement along a ground surface.

6. An apparatus as in claim 1 further comprising means for securing said panels to a ground surface.

7. An apparatus for enclosing a garage having a wall with a doorway therethrough, the doorway having a pair of spaced apart side walls and a top wall, comprising:

a guide track adapted to be fixedly mounted to the top wall of the doorway and to extend longitudinally therealong;

a first and second series of door sections, each said series including a plurality of door sections hingedly connected to each other and having upstanding guide elements adapted to slidably mount said door sections to said guide track for moving said first and second series in an accordion-like manner in opposing directions between a first extended position enclosing the doorway in a plane with said guide track and a second folded position in which said door sections are normal to the plane of said guide track;

a pair of auxiliary guide tracks adapted to be fixedly mounted adjacent to opposing side walls of the doorway and normal to said guide track, each auxiliary guide track being spaced apart from said guide track and adapted to receive one of said upstanding guide elements therein for slidable movement of said first and second series from said second folded position to a third position displaced from said guide track; and each said auxiliary guide track defining an enlarged opening for selectively allowing a respective series of door sections to be removed therefrom.

8. An apparatus as in claim 7 wherein each said door section includes a mesh material thereon for allowing air to pass therethrough.

9. An apparatus as in claim 8 wherein each said door section includes a plurality of louvers pivotally mounted thereto for allowing a selective amount of light therethrough.

10. An apparatus as in claim 7 wherein each said door section includes a plurality of louvers pivotally mounted thereto for allowing a selective amount of light therethrough.

11. An apparatus as in claim 7 wherein said guide elements are pivotal within said auxiliary guide tracks for pivotal movement of said first and second series from said third displaced position to a fourth storage position adjacent an outer wall of the garage.

12. An apparatus as in claim 11 wherein said first and second series include means for fastening said door sections to the garage wall at said fourth storage position.

* * * * *